US006857618B2

(12) United States Patent
Ludwig et al.

(10) Patent No.: US 6,857,618 B2
(45) Date of Patent: Feb. 22, 2005

(54) DEVICE FOR CONTROLLING A GAS EXCHANGE VALVE

(75) Inventors: Thomas Ludwig, Huenxe (DE); Udo Diehl, Stuttgart (DE); Bernd Rosenau, Tamm (DE); Simon Kieser, Sachsenheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/471,907

(22) PCT Filed: Jan. 17, 2003

(86) PCT No.: PCT/DE03/00121

§ 371 (c)(1),
(2), (4) Date: Sep. 15, 2003

(87) PCT Pub. No.: WO03/076772

PCT Pub. Date: Sep. 18, 2003

(65) Prior Publication Data

US 2004/0089829 A1 May 13, 2004

(30) Foreign Application Priority Data

Mar. 8, 2002 (DE) ..... 102 10 334

(51) Int. Cl.[7] ..... F16K 31/02
(52) U.S. Cl. ..... 251/30.01; 251/33; 123/90.12
(58) Field of Search ..... 251/25, 30.01, 251/33; 123/90.12, 90.13

(56) References Cited

U.S. PATENT DOCUMENTS 4,957,075 A * 9/1990 Hasegawa ..... 251/30.01
5,193,494 A * 3/1993 Sono et al. ..... 123/90.12
5,255,641 A * 10/1993 Schechter ..... 123/90.12
5,572,961 A * 11/1996 Schechter et al. ..... 123/90.12
6,321,703 B1 * 11/2001 Diehl et al. ..... 123/90.12

FOREIGN PATENT DOCUMENTS

| | | |
|---|---|---|
| DE | 198 26 047 | 12/1999 |
| DE | 101 27 205 | 9/2002 |
| JP | 59 170414 | 9/1984 |
| JP | 60 040711 | 3/1985 |
| WO | 02/095195 | 11/2002 |

* cited by examiner

*Primary Examiner*—John Bastianelli
(74) *Attorney, Agent, or Firm*—Kenyon & Kenyon

(57) ABSTRACT

An apparatus for controlling gas exchange valves includes at least one valve positioner, associated with a gas exchange valve, and a pressure supply device which supplies the valve positioner with a fluid under high pressure. The valve positioner encompasses a working cylinder having a positioning piston, coupled to the gas exchange valve, which delimits an upper pressure space for opening the valve and a lower pressure space for closing the valve, and encompasses a control valve controlling the hydraulic pressure in the pressure spaces. In order to reduce the manufacturing costs and electrical energy demand of the apparatus, the upper pressure space is connected directly, and the lower pressure space via a restrictor throttle, to the pressure supply device; and the control valve is connected to the lower pressure space and to a relief line. Depending on the switch position, the control valve additionally connects the lower pressure space to the relief line or blocks it off from the relief line.

11 Claims, 1 Drawing Sheet

DEVICE FOR CONTROLLING A GAS EXCHANGE VALVE

FIELD OF THE INVENTION

The present invention relates to an apparatus for controlling a gas exchange valve in internal combustion engines.

BACKGROUND INFORMATION

In the apparatus of German Patent Publication No. 198 26 047, the lower pressure space or working space of the double-acting working cylinder, and the upper pressure space or working space of the working cylinder, are connected to the hydraulic pressure supply device via the control valve embodied as a 2/2-way solenoid valve with spring return. The pressure impingement surface or effective surface of the positioning piston delimiting the upper working space is larger than the pressure impingement surface or effective surface of the positioning piston delimiting the lower working space, so that upon opening of the control valve, a compressive force displacing the positioning piston against the pressure in the lower working space acts on said piston, and the positioning piston opens the gas exchange valve. The upper working space is additionally connected, via a second control valve also embodied as a 2/2-way solenoid valve with spring return, to a return line opening into a fluid reservoir.

To displace the positioning piston in the valve-opening direction, the second control valve is closed and the first control valve opened. As a result of the differing effective surfaces of the positioning piston, the positioning piston is displaced downward and opens the gas exchange valve over a valve stroke that depends on the control valve activation duration. The valve stroke speed depends on the magnitude of the fluid pressure or hydraulic pressure applied by the pressure supply unit. To close the gas exchange valve, the two control valves are switched over so that the upper working space is on the one hand closed off from the pressure supply device and on the other hand connected to the return line. The positioning piston is displaced upward by the pressure present in the lower working space, and closes the gas exchange valve.

To hold the gas exchange valve in the closed position after a complete depressurization of the pressure system resulting from a slight leakage, e.g. when the internal combustion engine is shut off for an extended period or in the event of failure of the pressure supply device, an emergency closure spring is provided which is inserted as a compression spring into the lower working space and is braced against the positioning piston. The emergency closure spring is dimensioned so that in all conditions it overcomes the frictional torques in the gas exchange valve and in the valve positioner, and is capable of moving the positioning piston out of any of its displacement positions into the closed position.

SUMMARY OF THE INVENTION

The apparatus according to the present invention for controlling a gas exchange valve is believed to have the advantage that with similar functionality, the apparatus requires only a single electric control valve per gas exchange valve. The elimination of one control valve per gas exchange valve not only reduces the number of control valves by half, but also halves the number of power output stages required in the control device in order to activate the control valves.

A considerable savings potential in terms of manufacturing costs is thus achieved, which is significant e.g. in the case of a four-cylinder internal combustion engine having sixteen valves, eight control valves, and eight power output stages. In addition, electrical energy consumption and electrical cabling complexity are reduced. As a result of the smaller number of control valves, installed volume is reduced and the failure probability of the apparatus is decreased. All in all the apparatus is less complex than the one referred to above.

According to an exemplary embodiment of the present invention, the control valve is embodied as an electrically actuated distributing valve. The distributing valve may be a 2/2-way solenoid valve. In this simplest form of implementation of the control valve, a variable stroke for the gas exchange valve can be achieved only with short opening times, by interrupting the valve stroke. In addition, only the opening time and closing time of the gas exchange valve can be defined.

If the intention is to be able to influence the valve stroke for longer opening times as well, then according to a exemplary embodiment of the present invention the 2/2-way solenoid valve is switched over in cycled fashion, the cycle frequency may be selected as a function of the desired valve stroke in such a way that in the context of a displacement travel of the positioning piston corresponding to the desired valve stroke, the fluid flows flowing on the one hand through the restrictor throttle and on the other hand through the 2/2-way solenoid valve are of identical magnitude.

According to an alternative embodiment of the present invention, an electrically actuated proportional valve can also be used instead of a cycled 2/2-way solenoid valve. In order to achieve the variable valve stroke, the proportional valve is activated in such a way that in the context of a displacement travel of the positioning piston corresponding to the desired valve stroke, the fluid flows flowing on the one hand through the restrictor throttle and on the other hand through the proportional valve are of identical magnitude, and an equilibrium of forces is thus established between the upper pressure space and the lower pressure space.

DETAILED DESCRIPTION

Figure 1:
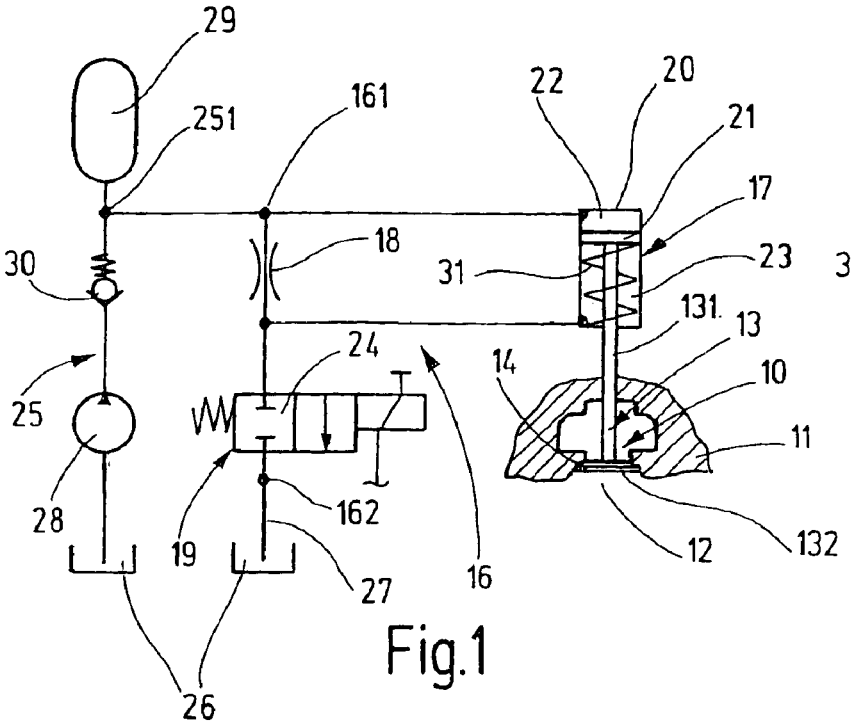
FIG. 1*a* shows a schematic diagram of an apparatus for controlling a gas exchange valve in an internal combustion engine.

The apparatus depicted in FIG. 1 in the block diagram serves to control gas exchange valves 10 in internal combustion engines. The internal combustion engine for a motor vehicle usually has four or more combustion cylinders, of which one cylinder head 11 of one combustion cylinder is depicted partially in FIG. 1. Configured in the combustion cylinder is a combustion chamber 12, closed off by cylinder head 11, that has at least one inlet cross section and one outlet cross section, each controlled by a gas exchange valve 10. Each gas exchange valve 10 has, in known fashion, a valve member 13 having a valve closure element 132, sitting on a valve shaft 131 guided in axially displaceable fashion, that coacts with a valve seat 14 surrounding the inlet or outlet cross section in cylinder head 11. By displacement of valve shaft 131 in one axial direction or the other, valve closure element 132 lifts off from valve seat 14 or seats itself in sealing fashion thereonto.

Actuation of gas exchange valves 10 is accomplished by way of an electrohydraulic valve control apparatus that is depicted in FIG. 1 in the schematic diagram. In the valve control apparatus, a hydraulic valve positioner 16, also called an actuator, is associated with each gas exchange valve 10. Hydraulic valve positioner 16, having a hydraulic input 161 and a hydraulic output 162, encompasses a double-acting working cylinder 17, a restrictor throttle 18, and a control valve 19. Working cylinder 17 has, in known fashion, a cylinder housing 20 and a positioning piston 21, guided therein in axially displaceable fashion and coupled to valve shaft 131 of the associated gas exchange valve 10, that divides the interior space of cylinder housing 20 into an upper pressure space 22 and a lower pressure space 23. Upper pressure space 22 is connected directly, and lower pressure space 23 via restrictor throttle 18, to hydraulic input 161. The control valve, which is embodied in FIG. 1 as a 2/2-way solenoid valve 24, is connected on the one hand to lower pressure space 23 and on the other hand to hydraulic output 162. A relief line, embodied here as fluid return line 27, is connected to hydraulic output 162. All the valve positioners 16 are supplied by a pressure supply device 25 with a fluid, which may be hydraulic oil, under high pressure, for which purpose hydraulic input 161 of each valve positioner 16 is connected to a fluid output 251 of pressure supply device 25. Pressure supply device 25 encompasses a fluid reservoir 26 into which fluid return line 27 opens; a high-pressure pump 28 that takes in fluid from fluid reservoir 26 and delivers it at high pressure to fluid output 251 of pressure supply device 25; and a high-pressure accumulator 29, connected to fluid output 251, that serves as an energy reservoir and pulsation damper. A non-return valve 30 with a flow-blocking direction pointing toward the pump output is also positioned between the output of high-pressure pump 28 and fluid output 251 of pressure supply device 25.

The manner of operation of the valve control apparatus is as follows:

Pressure supply device 25 supplies pressurized fluid to double-acting working cylinder 17. In the static situation depicted in FIG. 1, the pressure in upper pressure space 22 and in lower pressure space 23 is of equal magnitude. Since, because of the coupling of valve shaft 131, the pressure impingement surface or effective surface of positioning piston 21 that delimits upper pressure space 22 is larger than the pressure impingement surface or effective surface that delimits lower pressure space 23, a compression spring 31, functioning as a return spring and braced on the one hand against cylinder housing 20 and on the other hand against positioning piston 21, is positioned in lower pressure space 23. Compression spring 31 is dimensioned such that when the pressure in the two pressure spaces 22, 23 is identical, it holds positioning piston 21 in its top-dead-center position depicted in FIG. 1, in which gas exchange valve 10 is closed, i.e. valve closure element 132 of valve member 13 sits sealingly on valve seat 14 on cylinder head 11. Compression spring 31, constituting the emergency closure spring, also simultaneously meets the requirement for returning gas exchange valve 10 to its closed state when the internal combustion engine is shut off for an extended period or in the event of a failure of pressure supply device 25.

In order to open gas exchange valve 10, 2/2-way solenoid valve 24 is switched over out of its switch position depicted in FIG. 1 so that lower pressure space 23 is depressurized because of its connection to fluid return line 27. As a result of the collapsing pressure in lower pressure space 23, positioning piston 21 moves downward and opens gas exchange valve 10. In order to close gas exchange valve 10, 2/2-way solenoid valve 24 is reset, thereby separating lower pressure space 23 from fluid return line 27. Fluid under high pressure flows through restrictor throttle 18 into lower pressure space 23, and positioning piston 21 is guided back, with the assistance of compression spring 31, into its top-dead-center position that closes gas exchange valve 10.

Figure 3:
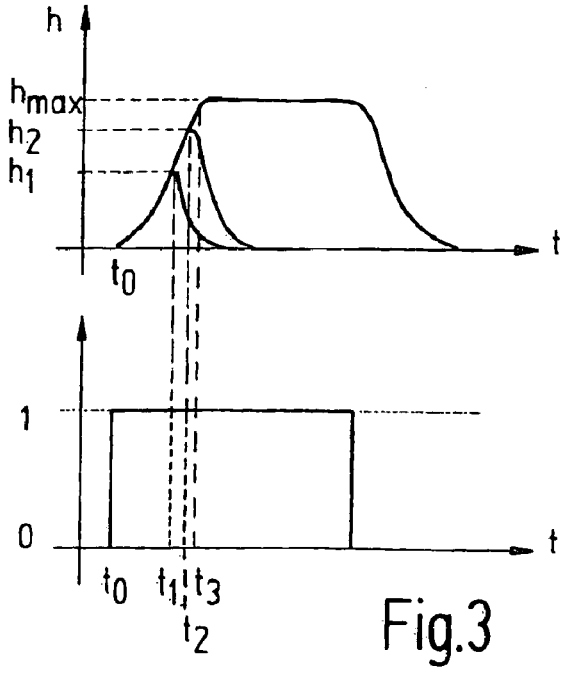
FIG. 3 shows two diagrams to explain the manner of operation of the valve positioner in FIG. 1.

The diagrams of FIG. 3 depict on the one hand the stroke h of valve member 13 of gas exchange valve 10 as a function of time t (top diagram), and on the other hand solenoid valve activation as a function of time t (bottom diagram). At time to, solenoid valve 24 is energized and thus switches out of its blocking position, so that lower pressure space 23 is connected to fluid return line 27. As a result of the decrease in pressure in lower pressure space 23, positioning piston 21 moves in the opening direction of gas exchange valve 10. If activation of solenoid valve 24 is terminated at time $t_1$ and the latter is reset to its blocking position, positioning piston 21 and valve member 13 have then executed a stroke $h_1$. As a result of the increasing pressure in lower pressure space 23, positioning piston 21 and valve member 13 now begin to move in the closing direction of gas exchange valve 10. If, however, solenoid valve 24 is not reset until time $t_2$, a stroke $h_2$ is performed and gas exchange valve 10 is opened further. With a slightly longer opening time $t_3$, valve member 13 reaches its maximum stroke $h_{max}$. It is evident from this that the desired variable stroke of gas exchange valve 10 can be achieved only for short valve opening times (less than $t_3$). This is, however, sufficient for most demands in terms of a variable valve train.

If the intention is to be able to influence the stroke of valve member 13 of gas exchange valve 10 for longer opening times as well, i.e. for opening times that are longer than $t_3$ in FIG. 3, solenoid valve 24 is then activated in cycled fashion. The cycle frequency is selected as a function of the desired valve stroke, specifically in such a way that for a displacement travel of positioning piston 21 corresponding to the desired valve stroke, the fluid flows flowing on the one hand through restrictor throttle 18 and on the other hand through 2/2-way solenoid valve 24 are of identical magnitude, and an equilibrium of forces is thus established at positioning piston 21 between upper pressure space 22 and lower pressure space 23.

Instead of the cycled 2/2-way solenoid valve 24, an electrically actuated proportional valve can also be used. This proportional valve is activated in such a way that for a displacement travel of positioning piston 21 corresponding to the desired valve stroke, the fluid flows flowing on the one hand through restrictor throttle 18 and on the other hand through the proportional valve result in an equilibrium of forces between the upper pressure space and lower pressure space 23. This is the case when the fluid flow flowing through restrictor throttle 18 is identical to the fluid flow flowing through the proportional valve. With the proportional valve controlled accordingly, any desired stroke of valve member 13 can be set and can be held for an arbitrary opening duration.

Figure 2:
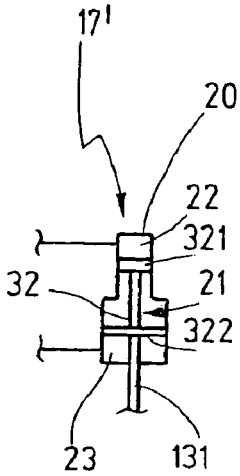
FIG. 2 shows an alternative exemplified embodiment of a valve positioner in FIG. 1.

The double-acting working cylinder 17' depicted schematically in FIG. 2 can be used in valve control apparatus 15 instead of working cylinder 17 depicted in FIG. 1. Working cylinder 17' is modified in that compression spring 31 is omitted, and positioning piston 21 is embodied as a stepped piston 32 having an effective surface 321 delimiting upper pressure space 22 and a effective surface 322 delimiting lower pressure space 23. Lower effective surface 322 is made substantially larger than upper effective surface 321. When the pressures in upper pressure space 22 and lower pressure space 23 are equal, the larger effective surface 322 delimiting lower pressure space 23 causes stepped piston 32 to be reliably displaced into its top-dead-center position and dependably held there, so that gas exchange valve 10 is also reliably held in its closed position. To ensure an emergency functionality, as mentioned above, in the event of system failure or an extended shutdown of the internal combustion engine, a compression spring similar to compression spring 31 in FIG. 1 can be provided, but it can be dimensioned to be substantially weaker and needs to ensure only that stepped piston 32 is held in its top-dead-center position.

What is claimed is:

1. An apparatus for controlling a gas exchange valve in an internal combustion engine, comprising:

at least one valve positioner, associated with the gas exchange valve, that encompasses a double-acting hydraulic working cylinder having a positioning piston, coupled to the gas exchange valve, which delimits an upper pressure space for actuating the gas exchange valve in an opening direction and a lower pressure space for actuating the gas exchange valve in a closing direction, and that encompasses a control valve controlling a hydraulic pressure in the pressure spaces; and a pressure supply device to supply the pressure spaces of the working cylinder with a fluid under high pressure, wherein the upper pressure space is coupled directly, and the lower pressure space is coupled via a restrictor throttle, to the pressure supply device, and the control valve is coupled to the lower pressure space and to a relief line, and, depending on a switch position, the control valve creates or blocks the connection between the lower pressure space and the relief line.

2. The apparatus of claim 1, wherein the control valve includes an electrically actuated distributing valve.

3. The apparatus of claim 2, wherein the distributing valve includes a 2/2-way solenoid valve.

4. The apparatus of claim 3, wherein to achieve a variable valve stroke, the 2/2-way solenoid valve is switchable over in cycled fashion.

5. The apparatus of claim 4, wherein the cycle frequency is set as a function of a desired valve stroke so that for a displacement travel of the positioning piston corresponding to the desired valve stroke, fluid flowing through the restrictor throttle and fluid flowing through the 2/2-way solenoid valve are of a same magnitude.

6. The apparatus of claim 2, wherein the electrically actuated distributing valve includes a proportional valve that, to achieve a variable valve stroke, is activated so that for a displacement travel of the positioning piston corresponding to a desired valve stroke, fluid flowing through the restrictor throttle and fluid flowing through the proportional valve are of a same magnitude.

7. The apparatus of claim 1, wherein a return spring to load the positioning piston against the pressure in the upper pressure space is located in the working cylinder.

8. The apparatus of claim 7, wherein the return spring includes a compression spring, located in the lower pressure space, that is braced in the lower pressure space and against the positioning piston.

9. The apparatus of claim 1, wherein the positioning piston includes an "upper" pressure impingement surface delimiting the upper pressure space and a "lower" pressure impingement surface delimiting the lower pressure space, the "lower" pressure impingement surface being larger than the "upper" pressure impingement surface.

10. The apparatus of claim 9, wherein the positioning piston includes a stepped piston.

11. The apparatus of claim 1, wherein the relief line includes a fluid return line opening into a fluid reservoir of the pressure supply device.

* * * * *

UNITED STATES PATENT AND TRADEMARK OFFICE

CERTIFICATE OF CORRECTION

PATENT NO. : 6,857,618 B2
DATED : February 22, 2005
INVENTOR(S) : Thomas Ludwig et al.

It is certified that error appears in the above-identified patent and that said Letters Patent is hereby corrected as shown below:

Column 4,
Lines 13-14, change "At time to" to -- At time $t_0$, --.

Signed and Sealed this

Twenty-third Day of August, 2005

JON W. DUDAS
*Director of the United States Patent and Trademark Office*